US006306015B1

(12) United States Patent
Bushell

(10) Patent No.: US 6,306,015 B1
(45) Date of Patent: Oct. 23, 2001

(54) METHOD FOR GRINDING RIGID MATERIALS

(75) Inventor: Scott B. Bushell, Greensboro, NC (US)

(73) Assignee: Machine and Wheels, Inc., Greensboro, NC (US)

( * ) Notice: Subject to any disclaimer, the term of this patent is extended or adjusted under 35 U.S.C. 154(b) by 0 days.

(21) Appl. No.: 09/476,551

(22) Filed: Jan. 3, 2000

(51) Int. Cl.[7] ..... B24B 1/00
(52) U.S. Cl. ..... 451/44; 451/57
(58) Field of Search ..... 451/41, 43, 44, 451/57, 65, 182, 184, 188, 331

(56) References Cited

U.S. PATENT DOCUMENTS

| | | | |
|---|---|---|---|
| Re. 29,097 | | 1/1977 | Bando . |
| 2,022,530 | * | 11/1935 | White . |
| 3,800,477 | | 4/1974 | Jendrisak et al. . |
| 4,179,851 | * | 12/1979 | Neisler et al. . |
| 4,203,259 | * | 5/1980 | Haddock . |
| 4,633,408 | | 12/1986 | Reinmold et al. . |
| 4,739,586 | | 4/1988 | Eckardt et al. . |
| 4,744,176 | | 5/1988 | Sack et al. . |
| 4,817,339 | | 4/1989 | Weidmo et al. . |
| 5,975,992 | * | 11/1999 | Raeder et al. ..... 451/44 |
| 6,159,081 | * | 12/2000 | Hakomori ..... 451/57 |

FOREIGN PATENT DOCUMENTS

| | | | |
|---|---|---|---|
| WO-88/09242-A1 | * | 12/1988 | (WO) . |

* cited by examiner

*Primary Examiner*—Timothy V. Eley

(57) ABSTRACT

A method and apparatus for processing of planar rigid materials is provided whereby the edges of separate materials can be processed simultaneously, quickly and efficiently. Separate planar materials are moved in position and are clamped in place in horizontal alignment. Thereafter a grinding wheel moves between the opposing edges of the planar materials to abrade the leading edge of one of the materials and the trailing edge of the second opposing material. The process describes abrading both the longitudinal and lateral edges of rectangular shaped materials moved along conveyors, such planar materials being glass, ceramic, stone or the like.

10 Claims, 4 Drawing Sheets

METHOD FOR GRINDING RIGID MATERIALS

FIELD OF THE INVENTION

An apparatus and method for abrading the edges of rigid materials such as glass plates is described whereby opposing edges of different glass plates are simultaneously abraded using a single grinding wheel.

DESCRIPTION OF THE PRIOR ART AND OBJECTIVES OF THE INVENTION

Various types of motor driven grinding machines have been available for many years in the glass and other industries whereby sheets or plates of various rigid materials are driven by conveyors and are stopped, clamped and ground (seamed) to remove rough, uneven and jagged edges. The grinding or abrading of the edges is also performed with glass sheets prior to heat tempering where edge uniformity is a requirement. U.S. Pat. No. Re. 29,097; U.S. Pat. Nos. 4,633,408; 4,739,586; 4,817,339 and 3,800,477 demonstrate various types of grinding apparatus and methods for processing or seaming the edges of glass with automated equipment.

Tile, stone, ceramics and other planar materials have been processed in the past with one grinding wheel utilized for each glass plate or other planar material. In certain seaming techniques the edges of glass plates are drawn across an abrasive belt system with the belts mounted at forty-five degree angles. Another prior art technique uses full edge grinding whereby glass plates are transported by a conveyor over a bank of grinding wheels of progressively finer abrasive size. Also, double edge grinding machines are currently used whereby glass plates are passed along a horizontal conveyor with a parallel banks of grinding wheels on each side of the glass plates.

Certain of the techniques and methods which are presently employed are time consuming and inaccurate or require precise adjustments for the particular size and thickness of the glass processed. Other disadvantages include extensive labor and handling, often causing high rejection rates. Certain of the prior art grinding techniques require highly accurate measurements be taken for different sizes and thicknesses of the glass sheets being processed and often rely on the skill of the particular operator to obtain an acceptable product.

Thus, with the problems and disadvantages of prior art methods of the various apparatus known, the present invention was conceived and one of its objectives is to provide edge grinding apparatus for rigid planar materials such as glass which is easy to set up and operate by relatively unskilled personnel.

It is yet another objective of the present invention to provide a method for grinding rigid materials whereby opposing edges of different materials are simultaneously abraded using a single grinding wheel.

It is yet another objective of the present invention to provide a method for grinding rigid materials which is automated for rapid, accurate production.

Various other objectives and advantages of the present invention will become apparent to those skilled in the art as a more detailed description is set forth below.

SUMMARY OF THE INVENTION

The invention as described includes apparatus and a method designed to automatically abrade all four sides of a rigid rectangular material such as glass plates along a horizontal plane without operator intervention and without the need for measurement of sizes or special machine calibration. The invention involves using one grinding wheel to simultaneously grind two edges of two different rigid planar materials such as glass, stone, ceramic or otherwise.

In a typical method of the invention a first planar glass material is placed on a first horizontal roller conveyor and is transported to a series of stops located therealong. When the leading (lateral) edge of the first planar material has located against the stops, a pneumatic clamping pressure bar system (usually one above and one below the planar material) is actuated to clamp the first planar material in position. With the first planar material now clamped, the roller conveyor is deactivated and the stops are retracted. A motor driven spindle holding a "V" formed diamond grinding wheel or other standard configuration such as a pencil edge wheel which is located on a motorized cross slide is now motor driven from right to left causing the periphery of the grinding wheel to come into contact with the leading (lateral) edge of the first planar material and to pass along its full leading edge dimension. An appropriate water feed from a recycling tank provides cooling action on the grinding wheel as it makes the traverse. The planar material now has a seamed leading edge. The motor driven spindle has now moved to the left side of the conveyor.

Next, the pneumatic clamps for the leading edge of the first planar material retract and the roller conveyor is reactivated causing the first planar material to be moved forward. A proximity sensor registers the passage of the first planar material and when it has fully exited the first conveyor and is on a second conveyor, a signal is given to reverse the second conveyor's direction. The planar material is now driven backward, toward the grinding wheel located between the two conveyors where a stop and clamp system causes the first planar material to locate against the stop and to be fixed in that position on the second conveyor by clamps as before. At this point, the lateral trailing edge of the first planar material is presented to the grinding wheel as the first planar material rests on the second conveyor.

During the time in which the first planar material is driven forward and then reversed, the next or second planar material which may be of different dimensions is moved by the first conveyor into the space recently evacuated by the first planar material. The second planar material comes into contact with the stop system and is clamped in place on the first conveyor.

At this point, while the first planar material is presenting its lateral trailing edge to the grinding wheel the second planar material is presenting its lateral leading edge to the same grinding wheel. The grinding wheel is now activated and it makes a pass from left to right causing the periphery of the grinding wheel to contact the lateral trailing edge of the first planar material and the lateral leading edge of the second planar material simultaneously. Afterwards, the grinding wheel resides at the right side, between the two conveyors. The clamps are released and the first planar material is evacuated in a forward direction by the second roller conveyor. Once evacuated, the second planar material now moves to the second conveyor as earlier described to take the place of the first planar material. Meanwhile the third planar material is now loaded onto the first conveyor and the sequence of operation of simultaneous dual material abrading is repeated at the first grinding wheel.

The first planar member is accelerated from the second conveyor into a right angle transfer system (drop-down belt system). The first planar member is now conveyed at a right angle to its original direction of transport and is processed through an identical second grinding wheel apparatus whereby the longitudinal edges of the planar material are likewise abraded as described above. When completed all four sides of the first planar material have been abraded and are ready for heat tempering or other processing. The operation continues for the second and all subsequent planar materials as required.

DETAILED DESCRIPTION OF THE PREFERRED EMBODIMENTS AND OPERATION OF THE INVENTION

Figure 1:
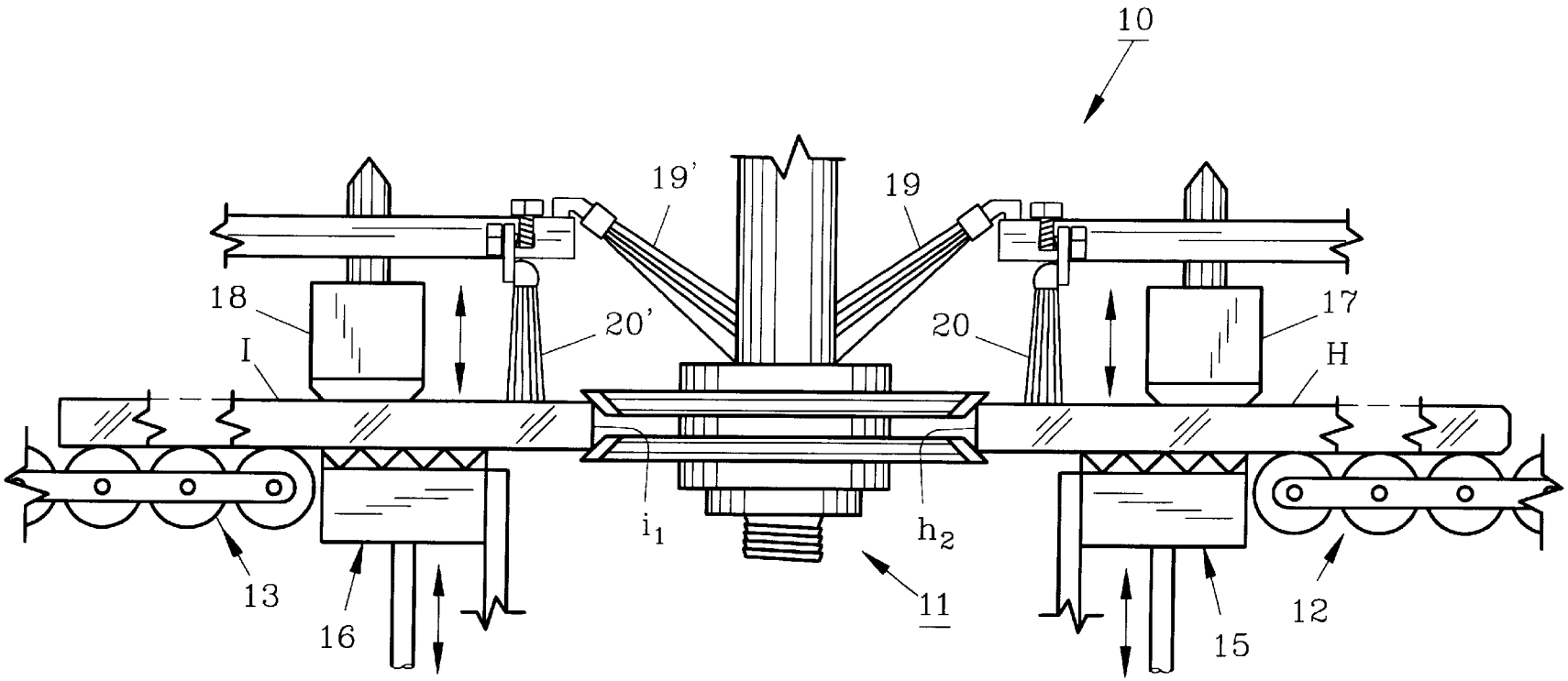
FIG. 1 shows in enlarged fashion the preferred grinding apparatus of the invention.

Turning now to the drawings, preferred apparatus 10 of the invention is shown in FIG. 1 wherein conventional grinding wheel 11 is shown positioned between first rigid planar material H and second rigid planar material I. Planar materials H and I are for example rectangular sheets of plate glass in horizontal alignment (seen in fragmented fashion in FIG. 1 for clarity) although other material such as ceramic tile, stone or other materials may be likewise processed. Grinding wheel 11 is moving along materials H and I simultaneously abrading or grinding the lateral trailing edge $h_2$ of material H and the lateral leading edge $i_1$ of material I. Apparatus 10 as shown in FIG. 1 consists of standard abrasive diamond grinding wheel 11, first roller conveyor 12 and second roller conveyor 13. At each end of conveyors 12 and 13 respectively as seen, lower bottom clamps 15 and 16 are positioned to hold rigid materials H and I with upper clamps 17, 18 as conventional in the industry. Clamps 15, 16, 17 and 18 apply force or pressure to rigid materials H and I to hold them in place as grinding wheel 11 traverses to abrade edges $h_2$ and $i_1$ of said materials. Clamps 17, 18 may be operated mechanically, pneumatically or hydraulically as is usual in the industry. Brushes 19, 19', 20, 20' assist in deflecting water and waste particles from rigid materials H and I and from grinding wheel 11 which may operate with a water spray (not shown), also conventional.

Thus, preferred apparatus 10 allows grinding wheel 11 to operate on the leading edge of a first planar material horizontally aligned with the trailing edge of a second planar material simultaneously as it passes therebetween. This simultaneous abrading provides speed and efficiency for processing such rigid, rectangular materials such as glass plates H and I shown herein. The spindle mechanism of grinding wheel 11 has a fine adjustment on the vertical axis (not shown) for centering of the grinding wheel to the planar materials A–K. A standard grinding wheel size of 150 mm is foreseen, permitting the use of a standard 3450 rpm direct drive electric motor (also not shown) although smaller diameter grinding wheels with higher rpms are also to be considered.

Figure 2:
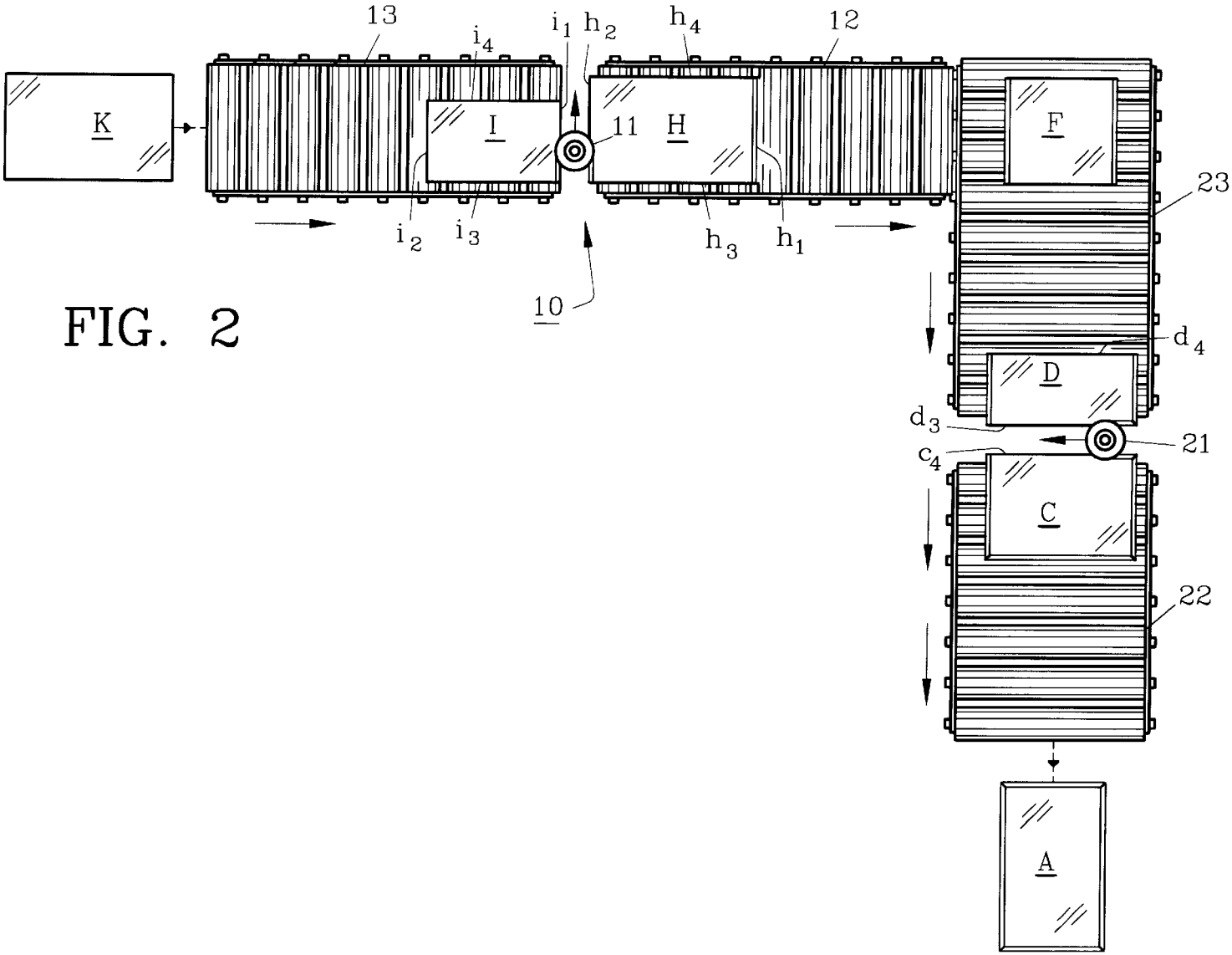
FIG. 2 demonstrates schematically the continuous processing of the rigid planar materials described herein.

In FIG. 2 the preferred manufacturing method of the invention is shown schematically with conveyors 12 and 13 in longitudinal alignment and with conveyors 22, 23 laterally disposed thereto whereby rigid planar materials A, C, D, F, H, I and K of different lengths and widths are shown as in a continuous production operation. As illustrated, material A has been abraded on all four sides and is ready for heat tempering or other process steps as necessary. Planar material C is being acted on by grinding wheel 21 along its longitudinal trailing edge $c_4$ whereas longitudinal leading edge $d_3$ of planar member D is being acted on simultaneously by grinding wheel 21. Planar material C is on conveyor 22 whereas planar materials D and F are on conveyor 23 which is in horizontal longitudinal alignment with conveyor 22.

As further shown in FIG. 2, grinding apparatus 10 pictures grinding wheel 11 abrading lateral trailing edge $h_2$ of sheet H and lateral leading edge $i_1$, of planar material I as in FIG. 1. Lateral edges $h_2$ and $i_1$ are shorter, respectively than longitudinal edges $h_3$ and $i_3$ although various lengths, thicknesses and widths of planar material H and I could be accommodated as needed. The manufacturing method shown in FIG. 2 is controlled by a standard programmable logic controller (PLC) not shown as is standard in the glass industry.

Figure 4:
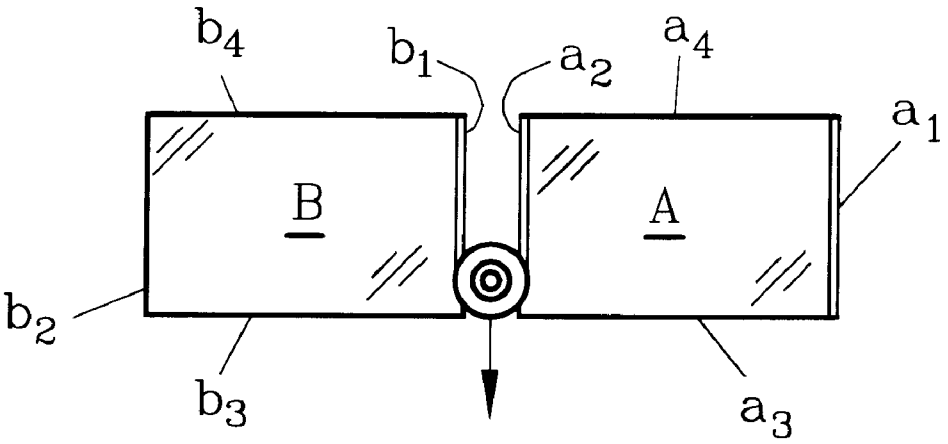
FIG. 4 depicts the second step of the preferred method as described herein.
Figure 3:
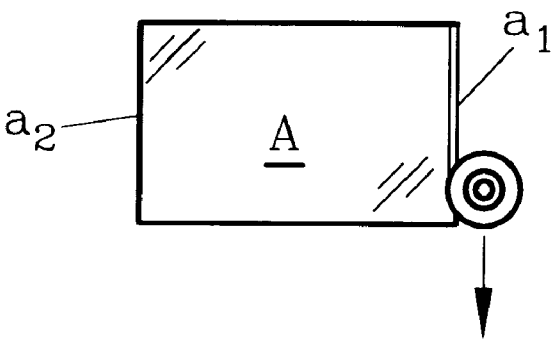
FIG. 3 illustrates the first step in the preferred method of the invention with the lateral leading edge being abraded of the first planar material.
Figure 7:
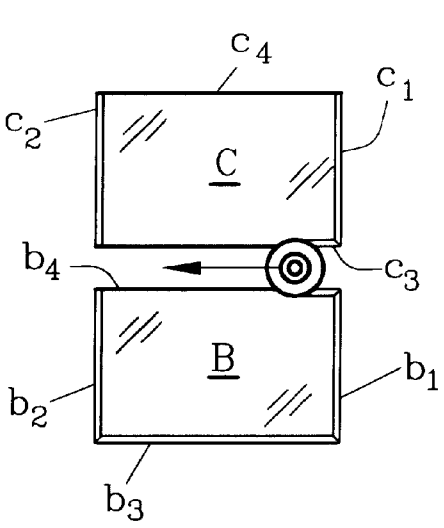
FIG. 7 shows the fifth step of the preferred method of the invention.
Figure 6:
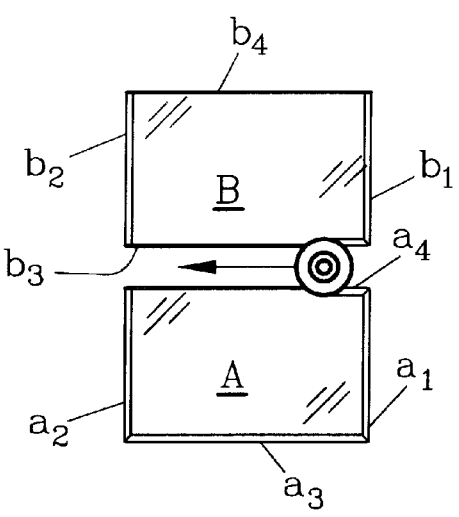
FIG. 6 shows the fourth step of the preferred method.
Figure 5:
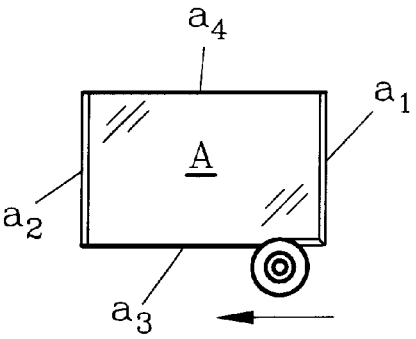
FIG. 5 shows the third step of the preferred method.

Thus, the method as seen and described in FIG. 2 allows a typical rigid, planar member which may be for example a glass sheet to be first abraded along its leading lateral edge $a_1$ , shown by material A in FIG. 3. Next, in FIG. 4 trailing lateral edge $a_2$ of material A is abraded simultaneously with leading edge $b_1$ , of planar material B. Next, the leading longitudinal edge $a_3$ of planar material A is abraded by grinding wheel 21 as shown in FIG. 5 and thereafter longitudinal trailing edge $a_4$ of sheet A is abraded as seen in FIG. 6 while simultaneously leading longitudinal edge $b_3$ of planar material B is also abraded. Finally, as seen in FIG. 7 trailing longitudinal edge $b_4$ of planar material B is abraded while simultaneously leading longitudinal edge $c_3$ of planar material C is abraded. The process can thus be continued for as many planar materials as needed during a typical production run.

Thus, with the opposing edges of two different planar materials abraded simultaneously, speed and efficiency in the operation is thus derived. Clamping, spraying and indexing of planar materials A–K are well known in the industry and the controls and mechanisms used are not shown herein for clarity and brevity purposes.

All illustrations and examples provided herein are for explanatory purposes and are not intended to limit the scope of the appended claims.

I claim:

1. A method of abrading planar materials comprising the steps of:

a) selecting a first planar material having first and second edges;

b) selecting a second planar material having first and second edges;

c) aligning an edge of said first material to oppose an edge of said second material; and d) moving a grinder in a linear direction between the opposing edges of said first and second planar materials to abrade the opposing edges simultaneously.

2. The method of claim 1 wherein selecting a first planar material comprises the step of selecting a first rectangular glass sheet.

3. The method of claim 1 wherein selecting a second planar material comprises the step of selecting a second rectangular glass sheet.

4. The method of claim 1 further comprising the steps of:

a) aligning a third planar material having a first edge opposing the second edge of said second planar material; and b) simultaneously abrading said first edge of said third planar material and said second edge of said second planar material.

5. The method of claim 1 further comprising: directing said first and said second planar material in a first direction prior to abrading said opposing edges and after abrading, directing said first and said second planar materials in a direction normal to said first direction.

6. The method of claim 1 further comprising the step of opposing another edge of said first planar member with another edge of said second planar material and simultaneously grinding said opposing edges.

7. A method for abrading the edges of rigid rectangular materials comprising the steps of:

a) maintaining a first rectangular material in a stationary position;

b) maintaining a second rectangular material in a stationary position with an edge of said first material apposing an edge of said second planar material; and c) moving a grinder in a path between said opposing edges to simultaneously abrade the same.

8. The method of claim 7 wherein maintaining first material comprises the step of maintaining a first ceramic material.

9. The method of claim 7 wherein maintaining a second material comprises the step of maintaining a second ceramic material.

10. The method of claim 7 wherein maintaining first material comprises the step of maintaining a first stone material.

* * * * *